United States Patent [19]

Grant

[11] Patent Number: 4,645,096

[45] Date of Patent: Feb. 24, 1987

[54] BOTTLE NECK WITH RETAINING LIP FOR STOPPER

[76] Inventor: Alan H. Grant, 3208 Woodhollow Dr., Chevy Chase, Md. 20015

[21] Appl. No.: 616,711

[22] Filed: Jun. 1, 1984

[51] Int. Cl.[4] ..... B65D 39/00; B65D 39/14

[52] U.S. Cl. ..... 222/153; 222/563; 222/572; 215/31; 215/355

[58] Field of Search ..... 222/563, 572, 153, 566; 215/31, 355, 32, 296; D9/439, 373, 375, 384–386, 440, 449

[56] References Cited

U.S. PATENT DOCUMENTS

| | | | |
|---|---|---|---|
| D. 198,234 | 5/1964 | Lawton | D9/449 |
| D. 216,678 | 3/1970 | Wilcox | D9/439 |
| D. 254,446 | 3/1980 | Raitto | D9/439 X |
| D. 255,986 | 7/1980 | Chang et al. | D9/373 |
| 817,247 | 4/1906 | Huffer | 215/31 |
| 1,073,997 | 9/1913 | London | 215/31 X |
| 1,504,473 | 8/1924 | Hattes | 215/31 X |
| 1,773,291 | 8/1930 | Weaver | 215/31 |
| 3,405,832 | 10/1968 | Lukesch et al. | D9/439 X |
| 3,712,519 | 1/1973 | Collie | 222/563 |

FOREIGN PATENT DOCUMENTS

| | | | |
|---|---|---|---|
| 16217 | 7/1912 | Denmark | 215/31 |
| 1024212 | 2/1958 | Fed. Rep. of Germany | 215/31 |
| 920663 | 1/1947 | France | 215/31 |
| 181776 | 1/1936 | Switzerland | 215/355 |
| 5662 | of 1884 | United Kingdom | 215/31 |

*Primary Examiner*—Joseph J. Rolla
*Assistant Examiner*—Frederick R. Handren
*Attorney, Agent, or Firm*—Berman, Aisenberg & Platt

[57] ABSTRACT

A unique combination of a neck having a back wall which extends above a front wall and a closure for sealing an opening in the neck is disclosed. The back wall has a lip which extends into the opening for engaging the closure. The closure is inserted into the opening such that a groove in its upper surface is engaged by the lip to prevent movement of the closure out of the opening. Removal of the closure is accomplished by depressing it into the opening slightly to release the lip from the groove, and then rotating it about the front wall. In one embodiment, the front wall includes a tamper-proof tab which must break away from the front wall when the closure is rotated during a removal operation. Several embodiments of the upper edge and groove are shown.

20 Claims, 10 Drawing Figures

FIG 6A
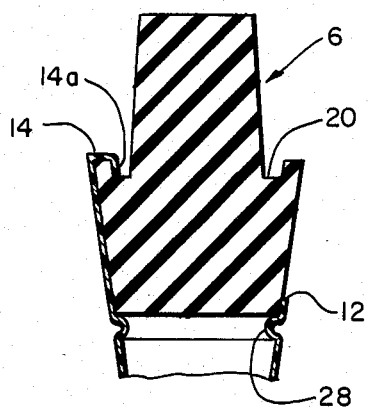
FIG 6B
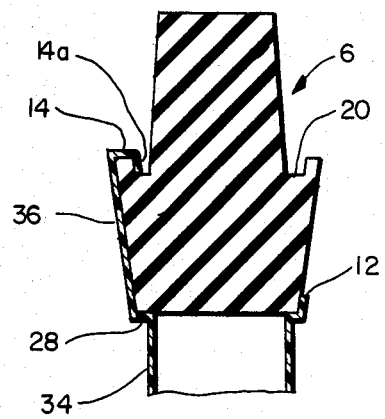
FIG 6C
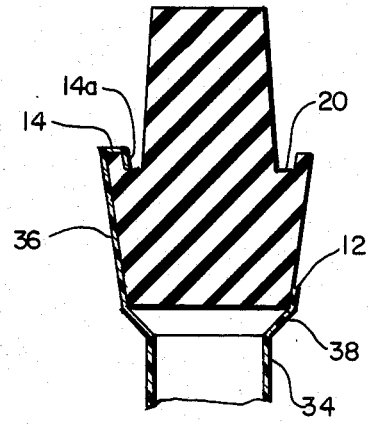
FIG 6D
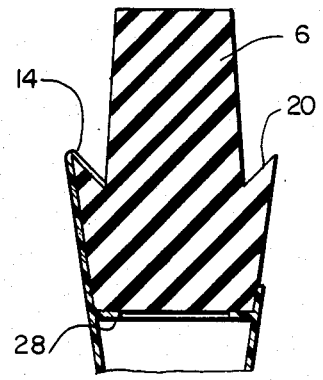
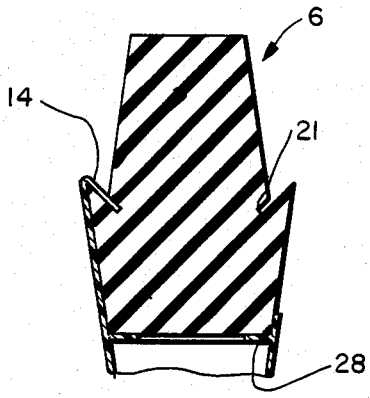
FIG 6E

BOTTLE NECK WITH RETAINING LIP FOR STOPPER

FIELD OF THE INVENTION

This invention relates to the art of closures.

BACKGROUND ART

It is known to provide a container with an opening for adding or removing material to the container, and the opening may have a closure for sealing the opening. A common form of closure is a tapered plug, usually made of cork, and the opening typically has a cylindrical or tapered interior surface which cooperates with the exterior surface of the plug to seal the opening. The upper surface of the opening is planar, and the plug is inserted into the opening in a direction perpendicular to this planar surface and removed in an opposite direction. Another common type of opening is a cylindrical neck having threads for receiving matching threads on a cap. The cap is applied to the neck by rotating it to engage the matching threads.

These forms of closures have many disadvantages. For example, the simple, tapered plug may be accidentally removed from the opening by an increase of pressure within the container. This is because the plug is held in the neck only by friction between the neck and the plug. The provision of a wire mesh or similar device to secure the plug is expensive and cumbersome. The screw-on cap is difficult to use since it requires a twisting motion. Furthermore, this type of cap seals by the cooperation between an upper edge of the neck and a small, annular portion of the cap, and this is frequently inadequate.

Various attempts have been made to improve upon these closures. U.S. Pat. No. 3,405,832 (Lukesch, et al.) shows a stopper which includes a tapered, annular portion for engaging a similarly-shaped portion of the neck of a container. Below the tapered portion of the stopper, is a ridge for engaging a lip on the container below the neck. The stopper is deformable so that the ridge on the stopper must be compressed to pass the lip of the container, thereby securing the stopper to the container. U.S. Pat. No. 3,095,995 (Foster) shows a plug pivotally attached to a container for sealing an opening in the container. The upper surface of the container having the opening is generally flat, and the plug is resilient for sealingly engaging surfaces of the opening. U.S. Pat. No. 3,362,565 (McCormick) shows a container having an opening formed by a shoulder which is engaged by a sealing bead on the lid.

SUMMARY OF THE INVENTION

The invention comprises a novel neck forming an opening and a plug for closing the opening. The neck may be an integral part of a container or may be adapted to be affixed to an existing container. The unique neck includes an upstanding back wall and a front wall. The back wall is taller than the front wall to provide a unique method of inserting and removing the plug and a novel means for securing the plug to the neck.

The back wall of the neck includes a lip which extends toward the front wall and engages an upper surface of the plug when the plug is in an operative position in the neck. The lip preferably extends along the entire back wall but alternatively extends along only a portion of it. The plug is preferably inserted by placing one surface of the plug against an upper edge of the front wall and rotating it into position whereby the lip engages the plug. The lip preferably engages a groove in the plug, but alternatively engages any part which will resist movement out of the opening. The plug is preferably resilient so that when the plug is placed in an operative position, it must be compressed slightly. After the plug is in an operational position, it expands to engage the lip and seals the container. Removal of the plug requires slight movement downward to disengage the lip from the plug and subsequent rotation of the plug about the lower, front wall. This operation is easily performed by an adult and results in a child-proof feature because of the required dual motion. The elderly, arthritics, or otherwise incapacitated persons can perform these motions. The plug includes a knob for facilitating the grasping of the plug by persons with limited movement of their fingers.

Engagement of the lip with the plug also prevents accidental dislodgement of the plug, for example, by pressure of a carbonated liquid within the container.

In the preferred embodiment, the neck is generally cylindrical, and the back wall is connected to the front wall by side walls having sloped upper edges. The neck may, however, have other shapes, such as rectangular.

A tamper-proof feature is provided in one embodiment by a frangible tab attached to an upper edge of the front wall. Because removal of the plug requires rotation about this upper edge, any opening of the container will necessarily break the frangible tab, thus indicating that the container has been opened.

The plug is preferably tapered and takes the form of a truncated cone. The inner walls of the neck are similarly shaped to provide a seal with the plug. In a preferred embodiment, the neck includes a shoulder for engaging the bottom of the plug to limit the extent to which the plug may be inserted into the neck.

It is an object of this invention to provide a closure which is easily operated and highly efficient.

It is a still further object of this invention to provide a neck having a back wall which extends above a front wall and a plug which is inserted into the neck by rotation about an upper edge of the front wall.

It is a still further object of this invention to provide a closure wherein an upstanding back wall has a lip for engaging an upper surface of a plug and wherein the plug is disengaged from the lip by rotation about a front wall.

BRIEF DESCRIPTION OF THE DRAWINGS

FIGS. 6*a* through 6*e* are alternative embodiments of the invention.

DETAILED DESCRIPTION OF THE INVENTION

Figure 1:
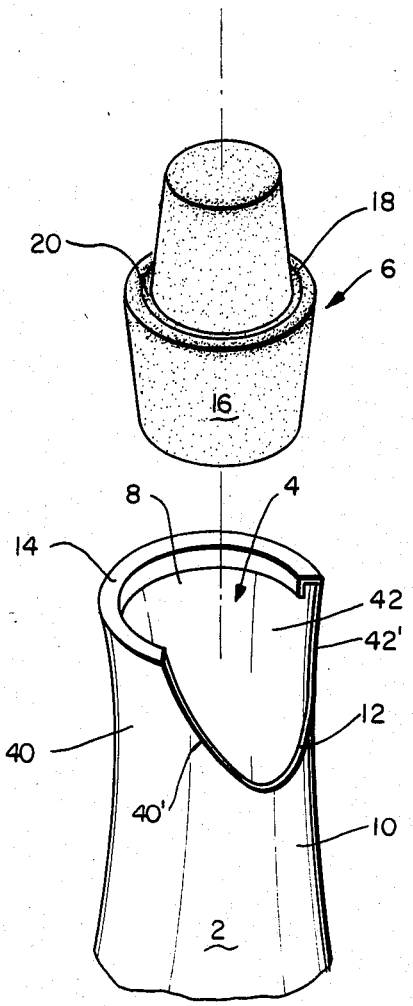
FIG. 1 is an exploded perspective view of a preferred embodiment of the invention.

FIG. 1 shows a preferred embodiment of the invention wherein a neck 2 has an opening 4 to allow material to flow from a container, or the like. A plug 6 is adapted to be inserted into the opening 4 for preventing the flow of material. Neck 2 is unique in that it includes a back wall 8 which is taller than a front wall 10. This construction allows a unique method of insertion and removal of the plug 6. Insertion is accomplished by placing one side of the plug 6 against an upper edge 12 of the front wall 10 and rotating it into the closed position shown in the remainder of the figures.

Back wall 8 includes a lip 14 which engages an upper surface of the plug 6 when the plug is in a position to close the opening 4.

Plug 6 includes a side wall 16 which is preferably tapered to substantially match the taper of neck 10, as will be more fully described below. An upper surface 18 of the plug 6 includes a groove 20 for receiving lip 14 when the plug is in an operational position closing the opening.

Figure 2:
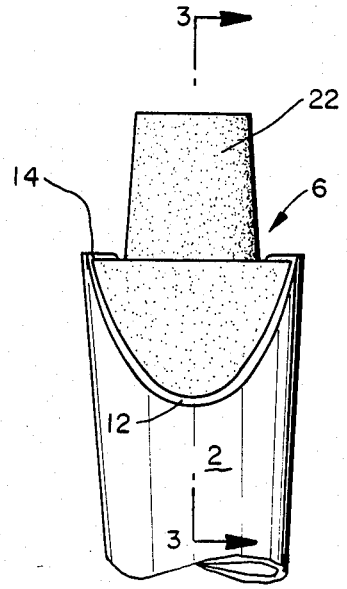
FIG. 2 is a front view of the invention.

FIG. 2 shows a front view of the plug 6 closing the opening in neck 10 and wherein the lip 14 is received by the groove 20 in the plug. A handle portion 22 of the plug 6 preferably extends above the lip 14 to allow the plug to be easily grasped. Of course, other methods of engaging the plug will be apparent to those of skill in the art.

Figure 3:
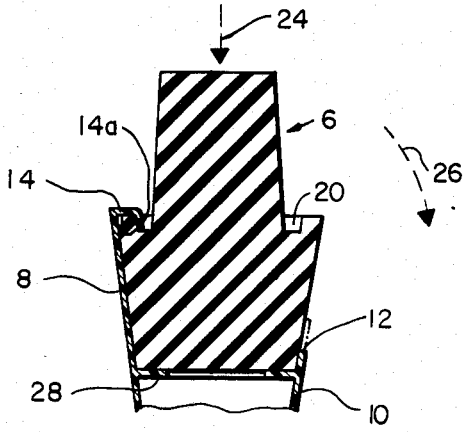
FIG. 3 is a cross-section taken along line 3—3 of FIG. 2.

FIG. 3 is a cross-section taken along line 3—3 of FIG. 2 and shows how a depending tip 14*a* of the lip 14 is received in the groove 20. FIG. 3 also clearly illustrates how the back wall 8 extends above the front wall 10. Removal of the plug is accomplished by first applying a force to move the plug in the direction shown by arrow 24 and then applying a force to rotate the plug in the direction shown by arrow 26. The rotation illustrated by arrow 26 preferably uses upper edge 12 as a fulcrum after the plug has been depressed and depending tip 14*a* has been displaced from the groove 20 to release the rear edge of the plug.

As shown in FIG. 3, the angle of taper of the plug is preferably substantially the same as the angle of taper of the upper portion of the neck 10 to provide a seal therebetween. Other tapers may be found to be useful, however.

In the preferred embodiment, the neck includes a ledge 28 which engages the bottom of plug 6 when the plug is in an operational position, as shown in FIG. 3. The plug 6 is preferably made of a resilient material to allow the depending tip 14*a* to be removed from the groove 20 while the bottom of the plug is in contact with ledge 28. Thus, when a force is applied in the direction of arrow 24, the plug compresses slightly to allow the plug to be rotated in the direction of arrow 26.

It will be apparent to those of ordinary skill in the art that the stopper in accordance with the invention will be easily inserted and removed and, yet, when in an operational position, pressure from within opening 4 will not force the stopper out of the opening. This is because the lip 14 engages an upper surface of the plug and prevents outward movement in the direction opposite to that of arrow 24. Pressure inside the neck 10 would produce only a force in this direction.

Figure 4:
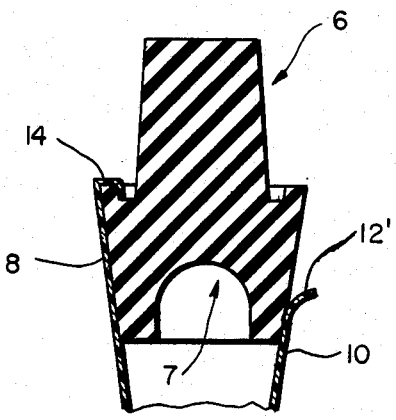
FIG. 4 is an alternative embodiment of the article shown in FIG. 3.

FIG. 4 shows another embodiment of the invention wherein the upper edge 12' is formed into a pouring spout. After the plug 6 is removed, the neck may be tipped to allow the contents of a container to pour over spout 12'. It will be appreciated, also, that the contents may be poured over lip 14 to allow one to view the material being dispensed in the region between the back wall 8 and the front wall 10. This may be particularly convenient when dispensing items such as pills since they may be brought into view before being dispensed. Furthermore, some fluids may be poured over the lip 14 in such a manner that there is no dripping because of the interaction between the lip and the fluid.

Plug 6 shown in FIG. 4 includes a measuring portion 7 formed by a concave cavity in the bottom of the plug. The cavity has a standard volume, such as one-half teaspoon, and may be used by removing the plug and pouring the contents of a container into the cavity.

Figure 5:
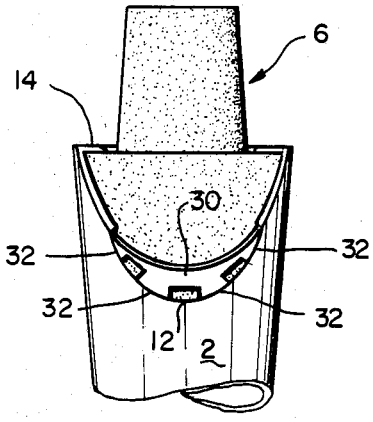
FIG. 5 is an alternative embodiment of the device shown in FIG. 2.

FIG. 5 shows an embodiment of the invention having a tamper-proof feature. A frangible tab 30 is attached to upper edge 12 at frangible connection points 32. The closure would be assembled by the manufacturing facility in the condition shown in FIG. 5. When it is desired to open the container, the plug 6 is depressed to disengage lip 14 from groove 20, and the plug is then rotated about the upper edge 12 of the front wall. This action necessarily breaks the frangible tab 30 away from the upper edge 12, thus clearly indicating to the consumer that the container has been opened. Since the plug must be rotated about the upper edge 12, there is virtually no way that the plug may be removed without causing the frangible tab 30 to be broken off.

FIG. 6*a* shows an embodiment of the invention wherein ledge 28 is formed by a toroidal depression in the neck 2.

FIG. 6*b* illustrates an embodiment wherein a lower portion 34 of the neck has a diameter smaller than an upper portion 36, and ledge 28 connects the upper and lower portions.

FIG. 6*c* shows an embodiment wherein a lower part 34 is narrower than an upper part 36, and a conical surface 38 connects the upper and lower portions to perform the function of the ledge 28.

FIG. 6*d* shows modified forms of groove 20 and lip 14. Lip 14 extends in a single direction, and the groove 20 is conical. FIG. 6*e* is similar to FIG. 6*d*, except that the groove includes an extension 21 which receives a terminal part of the lip 14. The embodiment shown in FIG. 6*e* is particularly useful because engagement of lip 14 with the extension 21 holds the plug 6 firmly.

With reference to FIG. 1, it is seen that the neck 2 includes side walls 40 and 42. These side walls have upper edges 40' and 42' which taper from the lip 14 to the edge 12. In the circular embodiment shown in FIG. 1, these surfaces merge into each other. It should be noted, however, that the closure need not be circular, and may have other shapes, for example, rectangular. In a rectangular embodiment, the rear wall, front wall, and side walls would be clearly delineated.

What is claimed is:

1. In combination, a neck forming an opening allowing the flow of material therethrough, and a closure means adapted to be inserted in said neck to prevent said flow of material, said neck comprising a back wall and a front wall for engaging respective side portions of said closure means to form a seal to prevent said flow of material, said front wall terminating in a top edge, wherein said back wall extends above the top edge of said front wall and includes a retaining means for overlying and engaging an upper surface of said closure means when said closure means is in an inserted position in said neck for retaining said closure means in said neck and wherein said retaining means is located above the top edge of said front wall and extends inwardly from said back wall and only partially around said opening so as to provide an unobstructed area between said front and back walls to allow said closure means to be tilted toward and away from said back wall about the top edge of said front wall during installation and removal.

2. A combination according to claim 1 wherein said front and back walls of said neck are curved and said side portions of said closure means are curved.

3. A combination according to claim 1 wherein said neck further comprises first and second side walls connecting opposite sides of said back wall to respective opposite sides of said front wall, and wherein each of said side walls has an upper edge which slopes from said back wall to said front wall.

4. A combination according to claim 3 wherein said front wall further comprises a pouring spout which extends from the top edge of said front wall in a direction away from said back wall.

5. A combination according to claim 3 wherein said front wall further comprises security tab means frangibly connected to the top edge of said front wall and extending upwardly therefrom, whereby, when said closure means is tilted about the top edge of said front wall, said security tab means is broken away from said front wall by engagement with said closure means.

6. A combination according to claim 1 wherein said retaining means is a lip which extends from said back wall toward said front wall.

7. A combination according to claim 6 wherein said upper surface of said closure means includes a depression for receiving said lip.

8. A combination according to claim 6 wherein said neck further comprises stop means for limiting the extent of movement of said closure means within said neck with respect to said front and back walls.

9. A combination according to claim 8 wherein said stop means comprises an annular edge which extends from said front and back walls into said opening.

10. A combination according to claim 8 wherein said stop means comprises a toroidal indentation in said front and back walls.

11. A combination according to claim 8 wherein said neck comprises a first portion having a first transverse dimension and a second portion having a second transverse dimension larger than said first transverse dimension, said stop means being formed by a surface connecting said first and second portions.

12. A combination according to claim 2 wherein said closure means includes a portion in the shape of a truncated cone.

13. A combination according to claim 12 wherein said upper surface of said closure means has a circular groove concentric with the axis of symmetry of said cone for receiving said retaining means.

14. A combination according to claim 13 wherein said groove extends in a direction parallel to said axis.

15. A combination according to claim 13 wherein said groove extends in a direction inclined with said axis.

16. A combination according to claim 1 wherein said closure means includes a gripping means for facilitating the grasping of said closure means, said gripping means extending upwardly from said upper surface.

17. A combination according to claim 1 wherein said closure means has a hollow portion for use in measuring amounts of said material.

18. A neck forming an opening for allowing the passage of material therethrough comprising a back wall and a front wall, said front wall terminating in a top edge, wherein said back wall extends above the top edge of said front wall and includes a lip projecting into said opening toward said front wall and adapted to overlie an upper surface of a closure means when said closure means is in said opening, wherein said lip is above the top edge of said front wall and extends inwardly from said back wall and only partially around said opening so as to provide an unobstructed area between said front and back walls adapted to allow a said closure means to be tilted toward and away from said back wall about the top edge of said front wall during installation or removal.

19. A neck according to claim 18 further comprising side walls connecting opposed sides of said back wall to respective opposed sides of said front wall, and wherein upper edges of said side walls slope from said back wall to said front wall.

20. A neck according to claim 19 wherein each of said walls is curved to form a circular opening in a plane transverse to said walls.

* * * * *